US005761839A

United States Patent [19]

Heikkila

[11] Patent Number: 5,761,839

[45] Date of Patent: Jun. 9, 1998

[54] DISPLAY DEVICE WITH PLASTIC LAMINATE AND FRAME

[76] Inventor: Unto A. Heikkila, 1502 So. Lakeside Rd. #316N, Lake Worth, Fla. 33460

[21] Appl. No.: 811,245

[22] Filed: Mar. 3, 1997

[51] Int. Cl.[6] ..... G09F 1/12

[52] U.S. Cl. ..... 40/730; 40/777; 40/790

[58] Field of Search ..... 40/705, 706, 707, 40/710, 729, 730, 731, 771, 777, 781, 790

[56] References Cited

U.S. PATENT DOCUMENTS

| | | | |
|---|---|---|---|
| D. 208,511 | 9/1967 | Rice . | |
| D. 243,378 | 2/1977 | Tharp . | |
| D. 284,587 | 7/1986 | Nally . | |
| 739,112 | 9/1903 | Santemma | 40/780 |
| 1,567,310 | 12/1925 | Weeks | 40/707 |
| 2,343,068 | 2/1944 | Luce . | |
| 2,816,377 | 12/1957 | Hastings . | |
| 2,823,478 | 7/1958 | Ostergaard et al. | 40/707 |
| 2,999,332 | 9/1961 | Stein . | |
| 4,017,989 | 4/1977 | Murray | 40/731 |
| 4,051,487 | 9/1977 | Storch | 40/710 X |
| 4,104,818 | 8/1978 | Hrabik | 40/707 |
| 4,391,053 | 7/1983 | Anthony | 40/735 |
| 4,510,707 | 4/1985 | Girard | 40/730 |
| 5,074,593 | 12/1991 | Grosso | 40/771 X |
| 5,307,574 | 5/1994 | Huff, Jr. | 40/781 |
| 5,323,552 | 6/1994 | Fritz | 40/731 |

FOREIGN PATENT DOCUMENTS

| | | | |
|---|---|---|---|
| 286866 | 12/1927 | United Kingdom . | |
| 726212 | 3/1955 | United Kingdom | 40/152 |

*Primary Examiner*—Brian K. Green
*Attorney, Agent, or Firm*—A. David Pellinen

[57] ABSTRACT

An advertising device or sign that has a plastic frame having a front that contains advertising. The advertisement is on a plastic laminate with holes around its periphery that engage pins on the back of the frame. The back further has receptacles that engage a holder that forms an optional pocket. The optional pocket contains items that can be handed out or mailed. The frames can be joined together to form a larger display than can be accommodated on a single frame.

12 Claims, 4 Drawing Sheets

DISPLAY DEVICE WITH PLASTIC LAMINATE AND FRAME

BACKGROUND OF THE INVENTION

The present invention relates to advertising displays and signs. In many fields products undergo rapid change and development. In some areas such as real estate, the constant turnover in homes, for example, means a new advertisement is frequently needed. There is a need for a product which meets the need for rapid and easily changed advertising displays and signs, is attractive, and is of relatively low cost.

A combined frame and holder is shown in Design Patent 208,511 to Leonard Rice. A frame holds a picture while the rear of a case is formed of a holder for memos and the like. The Rice holder is not detachable and the device cannot be attached to another identical device.

SUMMARY OF THE INVENTION

The present invention relates to a combined frame and holder in which the frame can be used alone or with the holder. The frame can be easily attached to another like frame and in fact a number of frames can be attached providing a large display area.

The present invention provides a display device which has a supporting frame and is provided on the front side with visual indicia and on the rear side with a pocket for retaining brochures, product information, memos, or written matter which are preferably related to the visual indicia on the front side. The display device is particularly applicable to the advertising field although numerous other applications will be apparent from the description of the invention.

The visual indicia is encased in a plastic laminate thereby adding durability to the indicia and preventing foreign matter such as dust or dirt from entering the encased matter.

The visual indicia can be any form of advertising such as information associated with stores, retail outlets, shops, hotels, ships, restaurants, taxis, vans, trucks, or busses. Any place or location that carries advertising is suitable for the advertising device of the present invention. Of course the visual indicia need not be limited to advertising content. It can be an artistic impression, a picture, an assembly of cut outs, in other words it can convey any kind of information.

A holder is attached at the rear of the frame to form a pocket. The pocket is intended to hold information related to the visual information provided on the front side. Thus the front side or front portion highlights the information which is contained in the pocket. The pocket information can be recipes, tourist guides, explanations of drugs or cosmetics, test presentations, pictures, business cards, or pictures. Clearly any type of information can be contained in the pocket. The pocket can thus hold matter that can be handed out or mailed to customers.

The frame is made of plastic and has upstanding pins to support the plastic laminate and receptacles to support or attach the holder to the frame. The laminate has a series of through holes on its peripheral portion which serve to engage the upstanding pins. If it is desired to provide a permanent fix of the laminate to the frame a tool can be used to apply heat to the pins melting the top of the pins causing the melt to flow over the laminate.

A primary object of the present invention is to provide a laminated device which portrays the subject matter intended to be conveyed or advertised.

A further object of the present invention is to provide a frame which can securely hold a plastic laminated device.

A further object of the present invention is to provide a pocket on the rear of the frame to hold material related to the subject matter portrayed on the front side of the frame.

A further object of the present invention is to provide a long lasting device that conveys a message on the front and contains a pocket on the rear side.

DETAILED DESCRIPTION OF THE INVENTION

Figure 1:
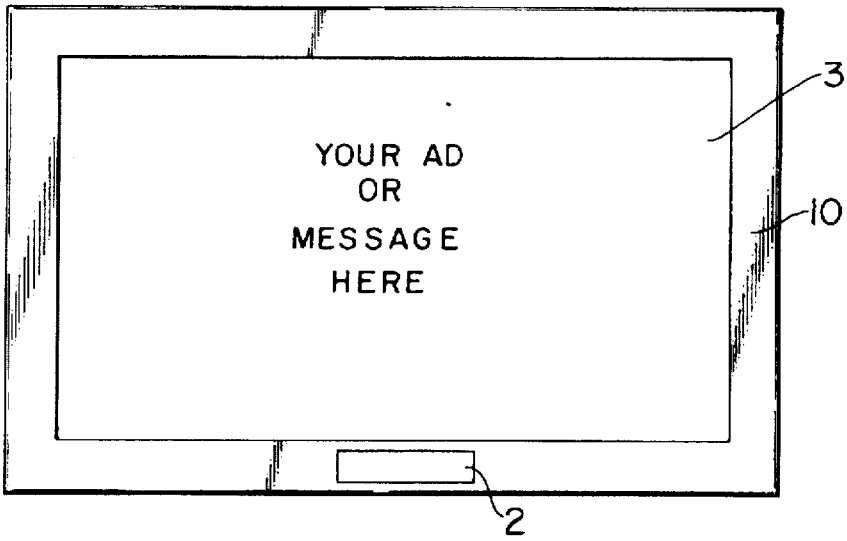
FIG. 1 is a front view of an embodiment of the present invention.

FIG. 1 shows a first embodiment of a frame of the present invention containing a message or any kind of advertising. The outline of frame 10 resembles an ordinary frame made of plastic. Plastic is the preferred material because plastic is relatively cheap, can be easily cleaned, and is durable. It is within the scope of the invention to make the frame out of any other suitable material. A plastic laminate 3, also referred to as a mat, bears an ad or a message which is desired to be conveyed. The message in FIG. 1, "YOUR AD OR MESSAGE HERE", is centrally located. Numeral 2 represents an optional area centrally located on the bottom frame leg and could be indented or raised. When present it serves to provide a suitable area to place any kind of identifying data such as the name of a person or organization, a logo, or the like.

Figure 2:
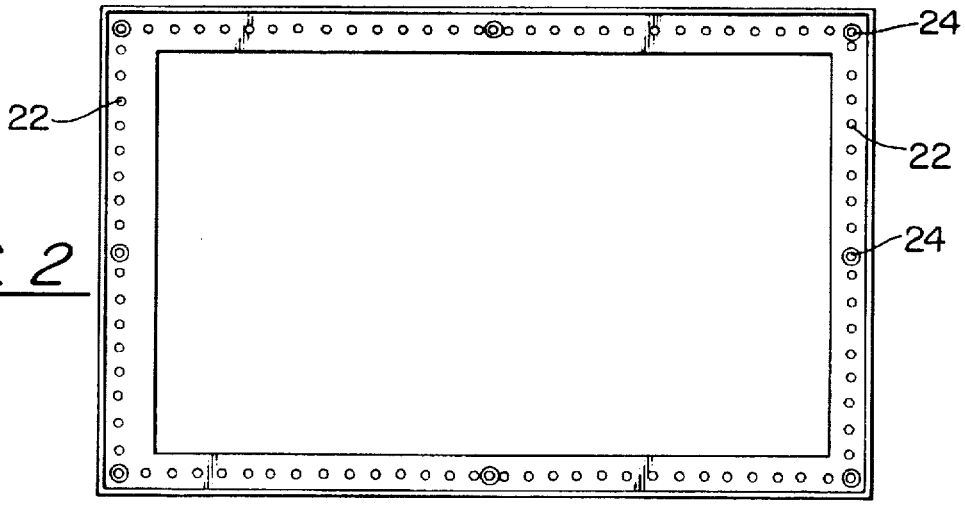
FIG. 2 is a rear view of the frame depicted in FIG. 1.

FIG. 2 is a rear view of the frame depicted in FIG. 1. The rear of the frame has a series of upstanding pins 22 around the periphery of the frame. These pins are integral with the frame and are spaced evenly around the edge of the frame although even spacing is not a requirement. These upstanding pins 22 serve to hold or fasten the laminate or other message bearing medium to the frame. Round receptacles 24 spaced at intervals around the frame support a holder or are used as an attachment means to other frames as will be described herinafter.

Figure 3:
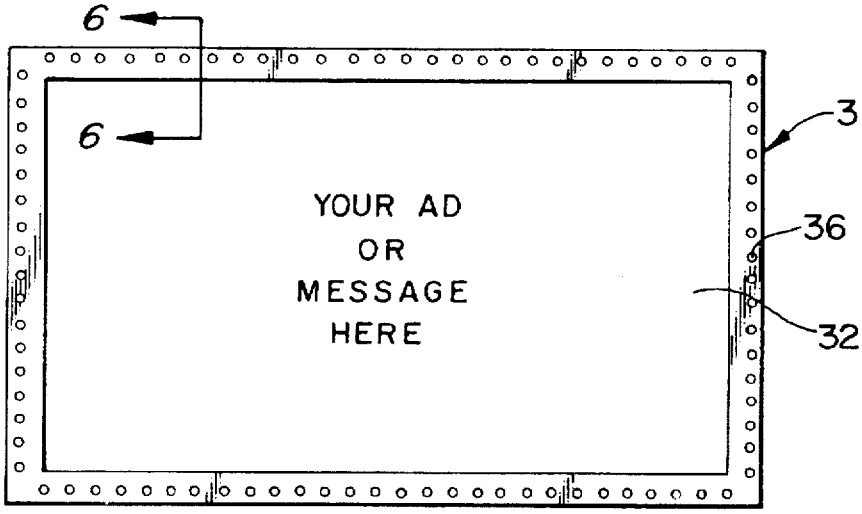
FIG. 3 is a front view of the laminate used in FIG. 1.

FIG. 3 shows the plastic laminate 3, or mat, which is used in FIG. 1. A central portion of the laminate has paper or some other message bearing medium 32 on which is placed or written a visual message or the like, in this case the same message shown in FIG. 1. Through holes 36 are around the periphery of the laminate which will engage the pins 22 shown in FIG. 2. The through holes are preferably slightly larger than the diameter of the pins but can be made approximately the same diameter to provide a snap type fit. The laminate as shown is generally rectangular in shape to conform to the frame. The plastic laminate is very flexible allowing it to be placed under the receptacles 24 shown in FIG. 2. The laminate, depending on design and use, could of course be sufficiently thick so that it is not flexible enough to go under the frame with ease. In such instances the corners of the laminate would be cut out or removed to permit the laminate to be freely placed on the frame. Additionally the laminate would have areas around its edge removed where it fits under the receptacles at the middle edge of the frame.

Figure 4:
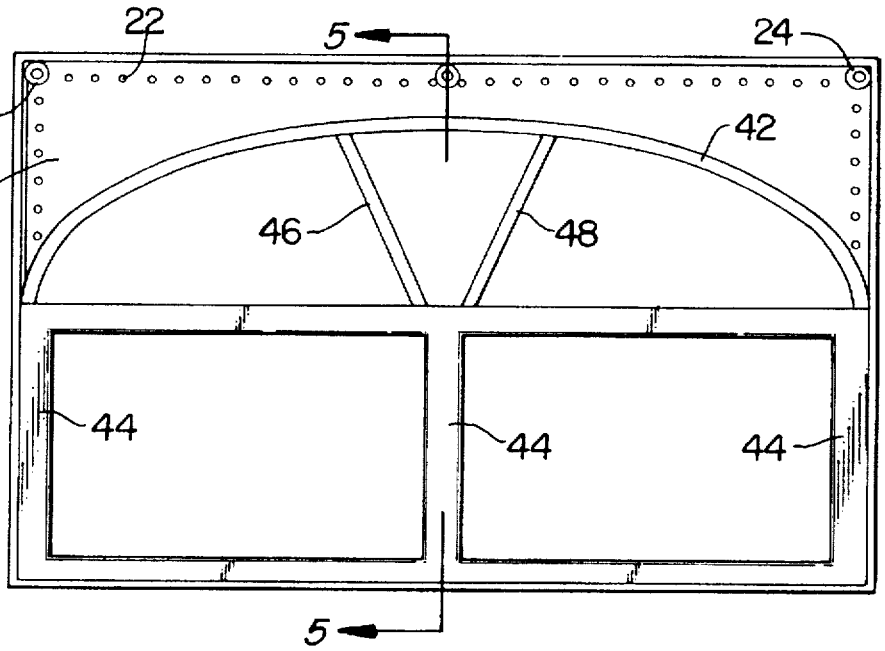
FIG. 4 is a rear view of of FIG. 1 with an attached pocket.
Figure 7:
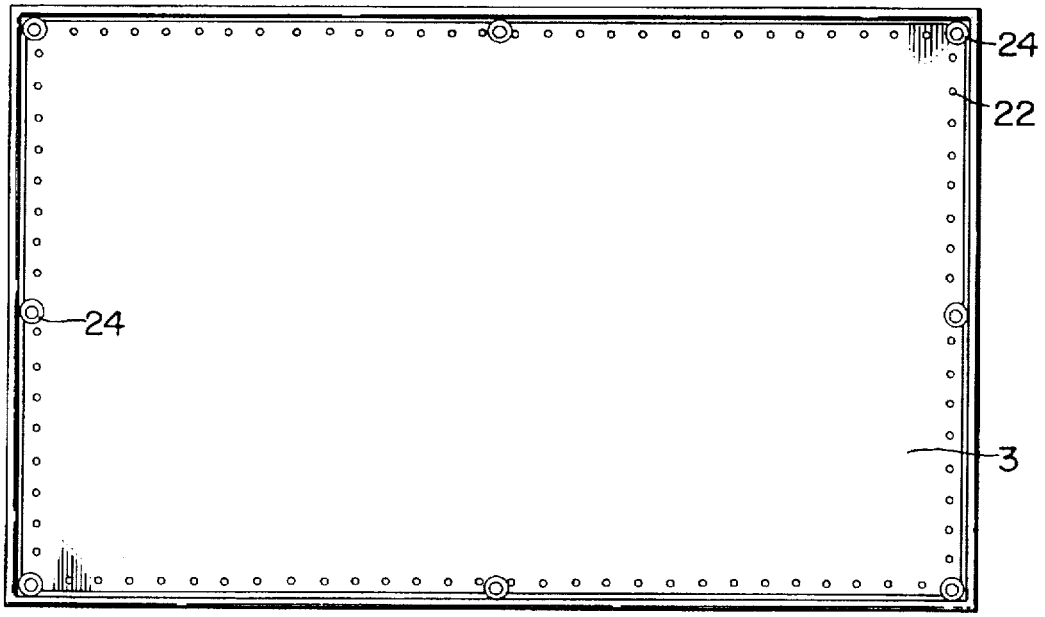
FIG. 7 is a rear view of of FIG. 1 without an attached pocket.

FIG. 4 is a rear view of the frame with an attached holder. The laminate 3 is engaged to the frame pins 22. The space between the holder and the laminate 3 becomes a pocket which serves to hold any information that can be related to the subject matter being portrayed or depicted at the front of the frame. The holder as shown has a generally curved upper portion 42, serving as a handle, connected at its ends to a bottom portion designated generally by 44. Portions 46, 48 extend from a central area of the handle to the bottom portion 44. The holder has projecting lugs, not shown, which engage corresponding round receptacles, or attachment means, on the frame at 24. Clearly the holder shown is merely illustrative and it could take any desired form. It need only be supported by, or attached to, the frame to provide a pocket for any printed matter or other material. While the use of the holder is advantageous its use is optional. Depending on the needs of the user it may not be desirable to have a holder. In that case the rear of the device appears as shown in FIG. 7.

Figure 5:
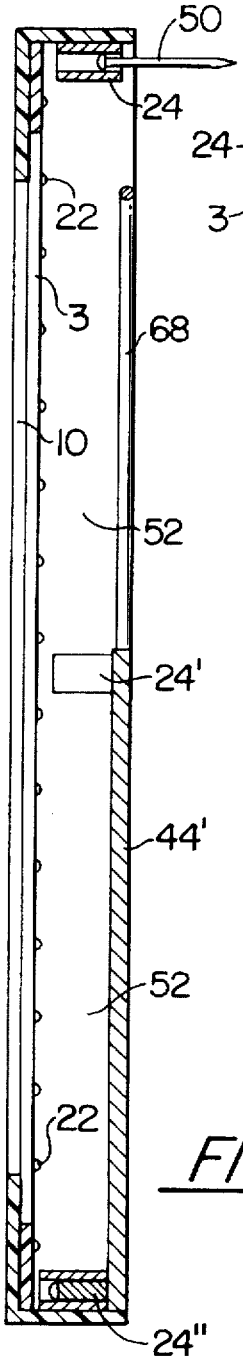
FIG. 5 is a view along the lines 5—5 of FIG. 1 enlarged for clarity.

FIG. 5 is a sectional view of the display device along the line 5—5 of FIG. 1. The FIG. 5 sectional view is enlarged for clarity. Shown more clearly are the pins 22 upstanding from frame 10 and passing through laminate 3. At the top of the frame is a receptacle 24 shown as engaging a nail, screw, or other like device 50 to support the display device. The receptacles 24 in the frame serve as attachment means for the holder's protruding lugs as shown at 24' which is a receptacle at the edge of the frame. At the bottom of FIG. 5 is shown a lug at the bottom of the holder engaging receptacle 24". The receptacles are round but they can be of any shape as long as they serve the function of attaching the holder to the frame. Visible in FIG. 5 is the pocket, designated generally by the numeral 52, which is formed by the space between the laminate 3 and the holder. The width of the frame is, of course, the determining factor in the width of the derived space between the frame and the holder. Depending on the content of the material contained in the pocket the space volume can vary widely from one application to another.

Figure 6:
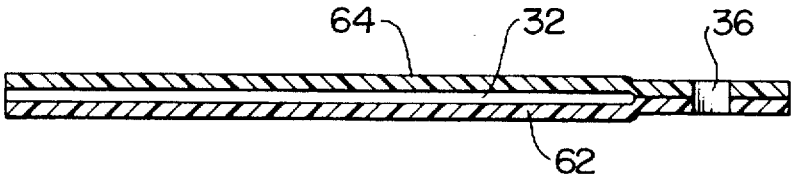
FIG. 6 is a view of the laminate along the lines 6—6 of FIG. 3.

FIG. 6 is a view along the line 6—6 of FIG. 3. Paper, or some other type of message bearing medium, 32 is placed on top of a plastic piece 62. Another plastic piece 64 is placed complementary to piece 62. The plastics are heated in a manner common in the art and the resulting laminate has a series of through holes 36 punched through it around the periphery of the plastic. The height of the laminate in the central portion is higher than at the edge and is of course due to the presence of the message bearing medium and the pressure and heat applied to the edge portions of the plastic pieces 62, 64.

As noted earlier the use of the holder is optional FIG. 7 is a view of the rear of the frame without the optional holder so that only a display medium is used. The pins 22 protrude through the holes of the plastic laminate 3. FIG. 7 thus has no pocket. In some cases it may be desirable for the message bearing medium to be displayed without an accompanying pocket. A receptacle, in this case the middle one, can be used to support the display device as shown in FIG. 5. There are however receptacles 24 present to hold an optional pocket should it be used at a later time. Eight of these receptacles are shown but the number provided is subject to choice. The receptacles 24 can also be used to connect a number of frames, as will be described hereinafter.

Figure 8:
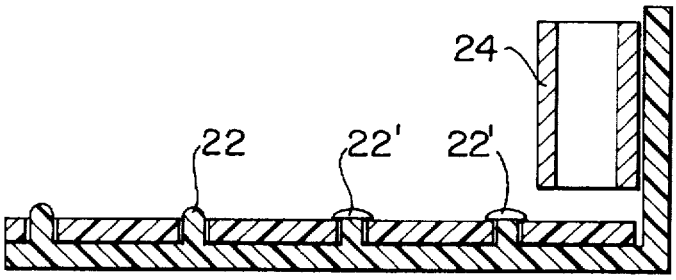
FIG. 8 illustrates how a melted pin fixes the laminate to a frame.

FIG. 8 shows how a melted pin fixes a laminate to a frame. Recall that the frame 10 of FIG. 2 has upstanding pins 22. It is possible that during normal use the display medium 3 can be dislodged from the pins and the frame. To prevent this from happening a suitable tool, not shown, heats the plastic pins. The pins 22 have a diameter slightly less that the through holes 36. The heat causes the plastic pin to melt, as shown at 22', and flow down the pin. The portion overlying the laminate 3 prevents the laminate from disengaging from the frame thereby providing a permanent fix between the plastic laminate 3 and the frame 10. The melted pin thus provides additional stability and rigidity to the device.

The receptacle 24 is more clearly shown in FIG. 8. It is molded at the same time the frame is molded and thus is integral with it.

Figure 9:
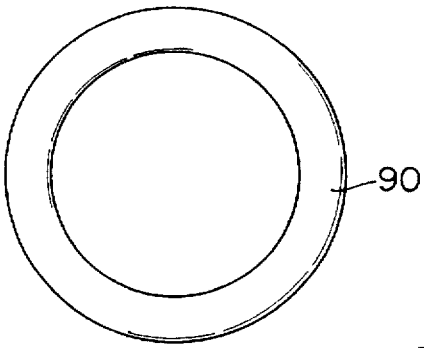
FIG. 9 is a front view of another embodiment using a round frame.
Figure 10:
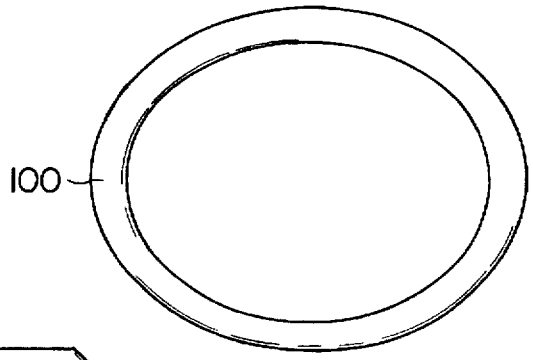
FIG. 10 is a front view of another embodiment using an oval frame.
Figure 11:
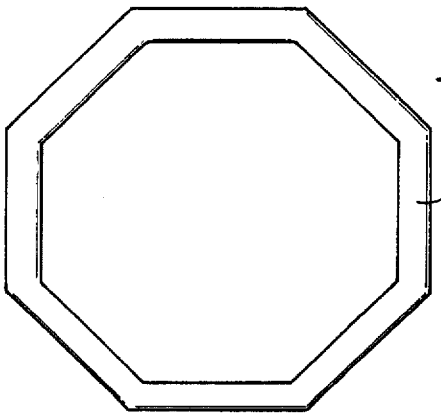
FIG. 11 is a front view of another embodiment using an eight sided frame.

The frame shown thus far is of generally rectangular shape but it could be of any shape. By way of example FIG. 9 shows another embodiment of the invention using a round frame 99. FIG. 10 shows a further embodiment showing an oval frame 100. FIG. 11 shows an eight sided frame 110. FIGS. 9–11 are illustrative of the fact that any shape frame is amenable to the teachings of the invention. Aesthetic considerations enter into the shape of the frame. In some cases the frame will a shape known to the public to be associated with a company product or logo. The shape when used in such an advertising context further strengthens the consumer relationship. The message bearing medium can have a similarly shaped outline. Plastic laminates are particularly suitable for the invention as they can be made in diverse forms and shapes.

The display mediums described thus far have a single frame. Where larger displays are needed it is a simple matter to merely mold a larger frame. There is a practical limit on the size of a frame, but it is also possible to provide a very large display by employing a multiple number of the inventive frames.

Figure 12:
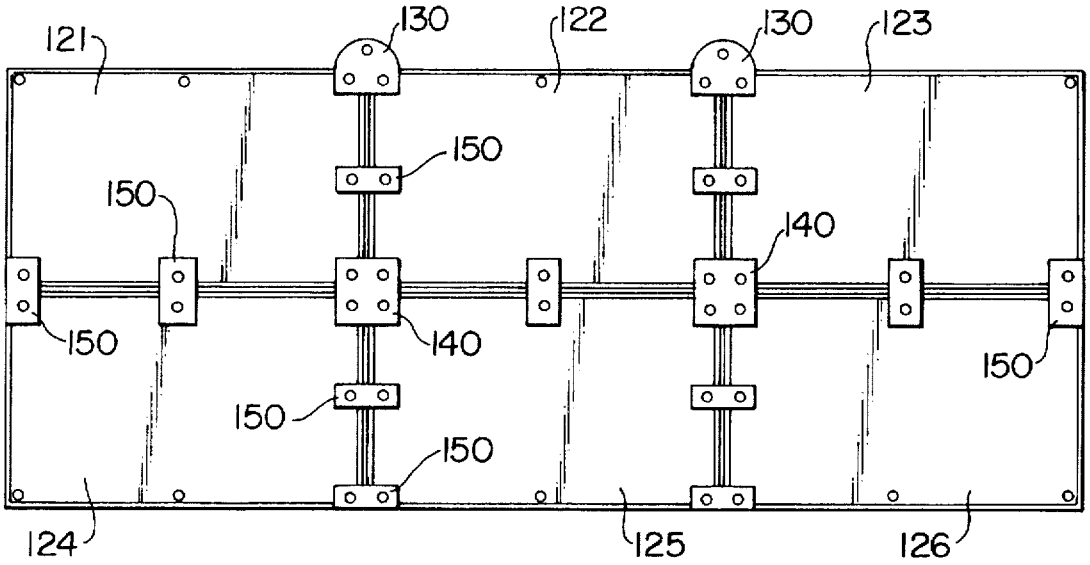
FIG. 12 is a rear view of a further embodiment using six frames.
Figure 13:
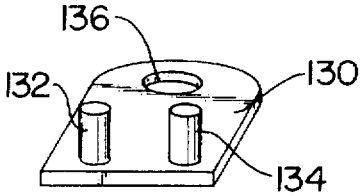
FIG. 13 is a view of a connector doubling as a support used in the FIG. 12 embodiment.

FIG. 12 shows a large display medium using six frames, 121–126, joined together. Frames 121–126 are each similar to the frame of FIG. 1. Referring briefly to FIG. 7 there are receptacles 24 located at the corners of the frame and at the middle of the frame legs. It is these receptacles that are used to connect the frames in FIG. 12. Connector 130 is shown in FIG. 13 to have upstanding pins 132 and 134 and a though hole 136. The pins 132, 134 of connector 130 are inserted into the receptacles at the top corners of the frames 121, 122, 123. The assembled six frames of FIG. 12 can then be supported by appropriate nails, screws, or the like through holes 136.

Figure 14:
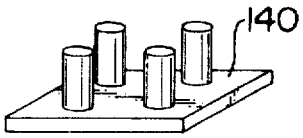
FIG. 14 is a view of a four pin connector used in the FIG. 12 embodiment.
Figure 15:
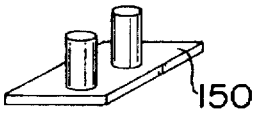
FIG. 15 is a view of a two pin connector used in the FIG. 12 embodiment.

Referring to FIG. 12 the frames are further joined by two types of connectors, 140 and 150. FIG. 14 shows connector 140 with four upstanding pins which engage the receptacles where the corners of frames 121, 122, 123 and 124 meet. Another connector 140 engages the pins where the corners of frames 122, 123, 125 and 126 meet. FIG. 15 shows connector 150 with two upstanding pins; these pins engage the middle receptacles such as where frames 121 and 122 meet. Connectors 150 are also used where adjacent corners of the frames meet, as at the bottom of FIG. 12.

Figure 16:
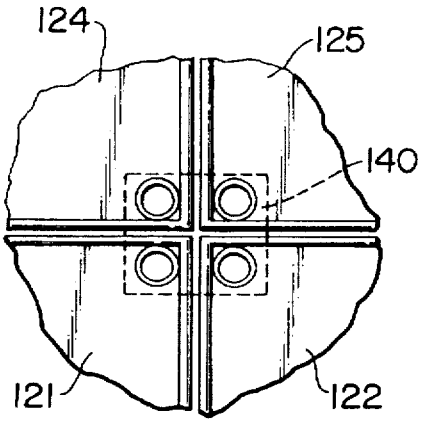
FIG. 16 is a bottom view where four frames adjoin each other in the FIG. 12 embodiment.

FIG. 16 is a bottom view of the area where the four frames 121–124 adjoin each other. The dotted outlines show the connector 140 with its pins in engagement with the receptacles.

In one use the embodiment of FIG. 12 has six different displays on the front sides. One of the displays may have a message, for example, that has become outdated; or a display that has an improved color version. Whatever the reason for making a change, it is a simple matter to remove of of the frames with its message and install another frame with a new message.

In another use the embodiment of FIG. 12 has a single image display too large to fit on one frame but easily accommodated on six adjoining frames. Because the frames are made of low cost plastic it is cost effective to replace one frame by another. Of course more than one frame may be put aside and then used during a later appropriate time. Where the option of snap-on laminates is used it is a simple matter of exchanging one laminate for another, keeping the same frame in use. Here too, more than one plastic laminate may be on hand, ready to be installed during an appropriate time. Thus the invention offers the ability to have many messages ready to be used, permitting flexibility in use, and allowing low cost alternatives for a user.

The invention is not limited to the pins as shown. Any mechanism which can hold an advertising medium in place would be suitable. Indeed the particular medium used will dictate the type of fastening device to be used. Similar considerations apply to the attachment means used. As noted the frame can be of any suitable shape. A user may want to use a shape commonly associated with the user such as a bottle, a can, an airplane outline, or any outline. The essential point is the frame can be tailored to a user's desires.

I claim:

1. A display medium comprising:

a supporting frame having a rear side;

said frame having fastening means on said rear side, said frame and said fastening means being of one piece;

a message bearing medium;

a plastic laminate having a central portion and a peripheral portion;

said message bearing medium located in said central portion of said plastic laminate, said message bearing medium encased by said plastic laminate;

a series of through holes in said peripheral portion of said laminate, whereby said series of through holes completely surround said message bearing medium; and said plastic laminate attached to said supporting frame by said fastening means.

2. The display medium of claim 1 wherein said fastening means are upstanding pins.

3. The display medium of claim 2 wherein said pins are melted to provide a permanent fix of said plastic laminate and said frame.

4. The display medium of claim 1 wherein said frame and plastic laminate are both rectangular.

5. A display medium comprising:

a supporting frame having a rear side;

said frame having fastening means on said rear side;

a message bearing medium;

a plastic laminate having a central portion and a peripheral portion;

said message bearing medium located in said central portion of said plastic laminate, said message bearing medium encased by said plastic laminate;

a series of through holes in said peripheral portion of said laminate, whereby said series of through holes completely surround said message bearing medium;

said plastic laminate attached to said supporting frame by said fastening means; and a holder attached to said rear side of said frame, whereby said holder and said frame form a pocket for receiving items.

6. The display medium of claim 5 wherein said frame has receptacles thereon; and said holder is attached to said frame by said receptacles.

7. The display medium of claim 5 wherein said fastening means are upstanding pins integral with said frame.

8. The display medium of claim 7 wherein said pins are melted to provide a permanent fix of said plastic laminate and said frame.

9. The display medium of claim 5 wherein said frame and said plastic laminate are both rectangular.

10. A display medium comprising:

at least two supporting frames;

each of said supporting frames having a rear side;

each of said supporting frames having fastening means on said rear side;

each of said supporting frames having attachment means on said rear side;

at least two message bearing mediums;

at least two plastic laminates, each having a respective central portion and a respective peripheral portion;

each of said message bearing mediums located in a respective central portion of said plastic laminates, each of said message bearing mediums encased by said plastic laminate;

a series of through holes in each said respective peripheral portion of each said plastic laminate, whereby said series of through holes completely surround each of said message bearing mediums;

each of said plastic laminates attached to said frames by said fastening means, and said supporting frames are joined to each other by connectors attached to said attachment means.

11. The display medium of claim 10 wherein said fastening means are upstanding pins integral with said frames.

12. The display medium of claim 10 wherein there are six frames.

* * * * *